United States Patent [19]

Boemer

[11] 4,261,118

[45] Apr. 14, 1981

[54] EXTRUDED LOCKING DEVICE FOR DIGGING TOOTH

[75] Inventor: John H. Boemer, Arlington, Tex.

[73] Assignee: Jetco, Inc., Grand Prairie, Tex.

[21] Appl. No.: 78,460

[22] Filed: Sep. 24, 1979

[51] Int. Cl.[3] ..... E02F 9/28

[52] U.S. Cl. ..... 37/142 A; 403/409

[58] Field of Search ..... 37/142 A, 142 R, 141 T; 299/92; 175/413; 403/409, 220

[56] References Cited

U.S. PATENT DOCUMENTS

| | | | |
|---|---|---|---|
| 3,305,954 | 2/1967 | Troeppl et al. | 37/142 A |
| 3,425,117 | 2/1969 | Hill | 37/142 R X |
| 3,864,854 | 2/1975 | Evans | 403/409 X |
| 3,952,433 | 4/1976 | Heinold et al. | 37/142 A |

FOREIGN PATENT DOCUMENTS

| | | | |
|---|---|---|---|
| 247189 | 12/1967 | U.S.S.R. | 299/92 |

*Primary Examiner*—E. H. Eickholt

*Attorney, Agent, or Firm*—Richards, Harris & Medlock

[57] ABSTRACT

An excavation digging tooth locking device is disclosed for frictionally maintaining a digging tooth in a female reception pocket in matingly wedged relation. The locking device is a sliced section of an extruded member compressively wedged into and filling a varying dimensioned gap between the tooth and the pocket. The locking device has a tubular portion with a slit across its longitudinal dimension and a pair of divergent wing portions extending from the opposing faces of the slit. The wing portions have tapered distal ends of reduced cross section. The interface of the wing portions and the tubular portion have enlarged cross sections. The inner perimeter of the tubular portion engages a reduced end bight section of the inner tooth wedge portion, the opposing faces of the slit engage the deepest sections of recessed detents adjacent the bight section, and the wing portions engage the tapering shallower sections of the detents.

6 Claims, 5 Drawing Figures

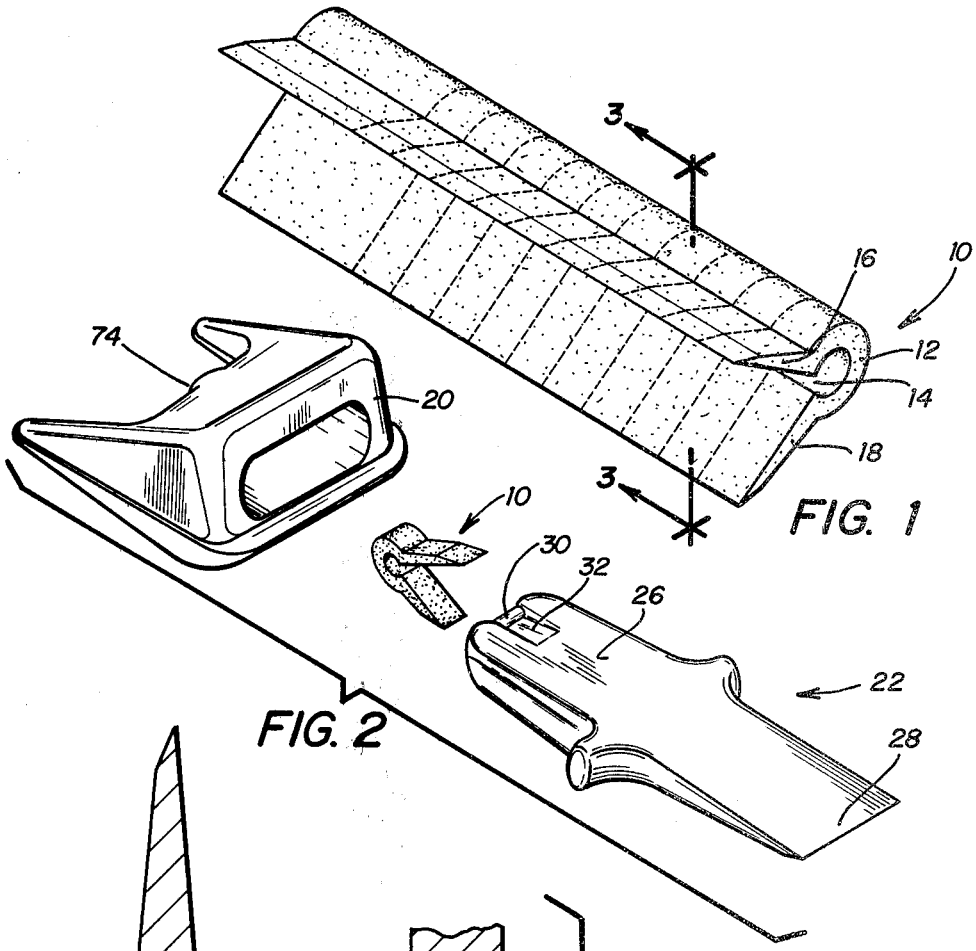
FIG. 1
FIG. 2
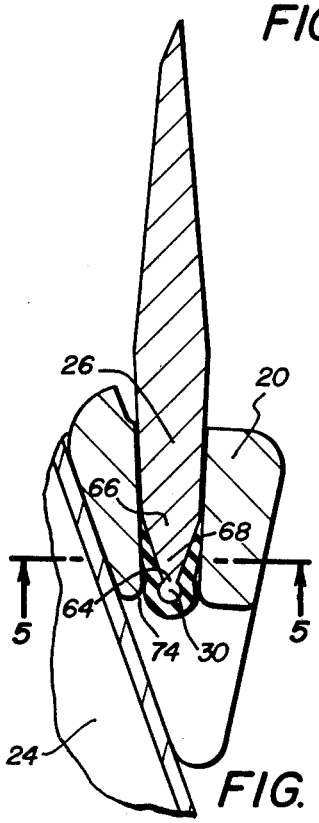
FIG. 4
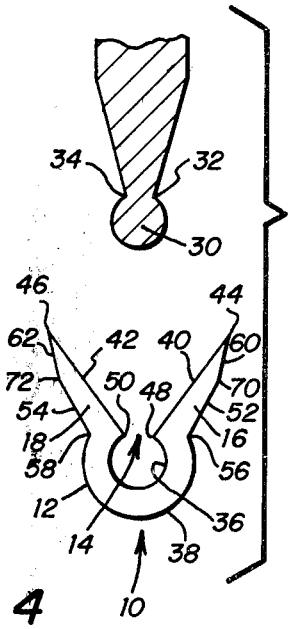
FIG. 3
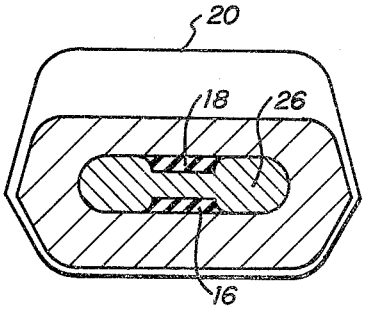
FIG. 5

EXTRUDED LOCKING DEVICE FOR DIGGING TOOTH

TECHNICAL FIELD

This invention relates to excavation apparatus and more particularly to frictional locking members for attaching a tooth in a female pocket.

BACKGROUND ART

Excavation equipment typically employ work engaging teeth for digging into the earth. These teeth are periodically replaced when they become worn, in order to maintain cutting ability of the excavation equipment.

It is customary to provide a tooth with an inner wedge male portion received in a female pocket in a generally complemental matingly wedged relation. A frictional locking device is employed which is compressed between the tooth inner wedge portion and the pocket to retain the tooth in mounted position. Various types and constructions of these frictional type locking devices have been used in the past, such as the device disclosed in U.S. Pat. No. 3,864,854 issued to C. J. Evans on Feb. 11, 1975. While these prior devices have been useful for their intended purposes, the present invention relates to improvements thereover particularly in reduced manufacturing costs and enhanced frictional retention.

DSCLOSURE OF THE INVENTION

The present invention significantly lowers the manufacturing cost of frictional locking devices for excavation digging teeth by enabling the use of an extruded locking device. The locking device is extruded as an elongated compressible member having a generally tubular hollow portion with a slit along its longitudinal dimension and a pair of diverging wing portions extending from opposing faces of the slit. The elongated extruded member is sliced transversely of its longitudinal dimension to yield a plurality of locking devices.

The invention further provides enhanced frictional retention of the digging tooth. The end of the inner tooth wedge portion has a reduced bight section gripped by the inner perimeter of the locking device tubular portion. The inner tooth wedge portion has recessed detents formed on opposing sides thereof. The deepest sections of the detents adjacent the bight are tapered to shallower depths and thicker cross sections to merge with the remaining cross sectional profile thickness of the inner tooth wedge portion. The wing portions of the locking device are tapered at their distal ends to a reduced cross sectional thickness to compensate and complement the tapered recessed detents such that the wing portions are compressed between the inner tooth wedge portion tapered recessed detents and the inner walls of the female reception pocket. The locking device has an enlarged cross sectional thickness at the interface of the tubular portion and the wing portions at opposing faces of the slit which engages the deepest sections of the recessed detents.

In preferred form, the locking device is compressed and deformed to substantially fill the gap between the inner walls of the female reception pocket and the recessed detents in the inner tooth wedge portion, to maximize the total frictional surface area engagement. Additionally, frictional retention is further enhanced because the preferred structure maximizes uniformity of friction along the entire surface of the locking device and minimizes isolated localized spots of increased friction.

BRIEF DESCRIPTION OF DRAWINGS

FIG. 1 is an isometric view of a pre-sliced extruded locking device constructed in accordance with the invention.

FIG. 2 is an exploded isometric view of a female reception pocket, locking device and digging tooth in preassembled condition.

FIG. 3 is an enlarged cross sectional view of a locking device taken along line 3—3 of FIG. 1, and also shows the inner tooth wedge portion in dotted line.

FIG. 4 is a cross sectional view of the female reception pocket, locking device and digging tooth in assembled mounting condition.

FIG. 5 is a cross sectional view taken along line 5—5 of FIG. 4.

DETAILED DESCRIPTION

There is shown in FIG. 1 a locking device generally designated by the reference numeral 10 constructed in accordance with the invention. The device is preferably formed of a resiliently compressible material such as high density PVC (polyvinyl chloride) and is extruded as an elongated member having a tubular portion 12 with a slit 14 along its longitudinal dimension and a pair of wing portions 16 and 18 diverging from the opposing faces of the slit. The elongated extruded member is sliced transversely of its longitudinal dimension as shown in dashed line in FIG. 1 to yield a plurality of locking devices.

Referring to FIG. 2, there is shown a female reception pocket 20 and a digging tooth 22. The pocket 20 is mountable to excavation equipment, as partially shown at 24 in FIG. 4. The pocket has slightly tapered inner walls, as seen in FIG. 4, for receiving the inner portion 26 of the tooth, also having slightly tapered walls, in matingly wedged relation. Outer portion 28 of the tooth engages the earth work to be excavated.

As seen in FIGS. 2, 3, and 4, inner tooth wedge portion 26 has a central reduced bight section 30 at the end thereof. Adjacent this bight section are tapered recessed detents 32 and 34 formed on opposite sides of inner tooth wedge portion 26. These detents have their deepest sections adjacent bight 30 and are tapered to shallower sections away therefrom to merge with the remaining cross sectional profile of the inner tooth wedge portion.

Referring to FIG. 3, the tubular portion 12 has inner and outer perimeters 36 and 38. Wing portions 16 and 18 have inner facing surfaces 40 and 42 with divergent distal ends 44 and 46 and convergent proximal ends 48 and 50 interfacing with inner perimeter 36 of the tubular portion to form the opposing faces of slit 14. The wing portions have outer surfaces 52 and 54 with convergent proximal ends 56 and 58 interfacing with outer perimeter 38 of the tubular portion. The distal ends of the wing portions are tapered at 60 and 62 to a reduced cross sectional thickness. The cross sectional thickness of tubular portion 12 and the non-tapered sections of wing portions 16 and 18 is substantially the same. The cross sectional thickness between interface points 52 and 56 and between interface points 50 and 58 is larger than the remaining cross sectional profile thickness of the locking device.

To mount tooth 22, locking device 10 is first mounted to the inner wedge portion thereof with inner perimeter 36 engaging bight section 30. The tooth and locking device are then inserted into pocket 20 to the position shown in FIG. 4. Opposing inner facing surfaces 40 and 42 of wing portions 16 and 18 engage tapered recessed detents 32 and 34 of the inner tooth wedge portion 26 and are compressed thereagainst by the inner walls of the pocket 20. As seen in FIG. 5, it is preferred that some deformation of the locking device occur.

Referring to FIGS. 3 and 4, it is seen that the thinnest cross sectional dimension of the inner tooth wedge portion 26 is between the deepest sections of detents 30 and 32, and thus leaves the widest gap to the inner walls of pocket 20. The opposed interfaces 48 and 50 of the wing portion inner surface proximal ends and the tubular portion inner perimeter 36 engage the deepest sections of the recessed detents 32 and 34 and thus the largest cross sectional segments of the locking device are advantageously provided at the widest gap segments between the inner tooth wedge portion 26 and the walls of pocket 20. Furthermore, the degree of taper of tapered segments 60 and 62 of the wing portions compensates and complements the tapered recessed detents 32 and 34.

The cross sectional dimension of bight 30, FIG. 4, is thicker than the dimension between the deepest sections of detents 32 and 34 but thinner than the cross sectional dimension of the upper nontapered section of inner tooth wedge portion 26. As the cross sectional dimension of inner tooth wedge portion 26 increases from point 64 to point 66, FIG. 4, along the tapered detents, this changing increasing cross sectional dimension will pass through a thickness which is equal to that of bight 30, for example point 68, FIG. 4. For manufacturing economy, the taper in each of the wing portions 16 and 18 have transition points 70 and 72, FIG. 3. These transition points 70 and 72 are initiated at a designated spot along the wing portions such that in assembled mounted condition, FIG. 4, they are directly opposite or slightly below (as viewed in FIG. 4) point 68 in the changing cross sectional thickness of inner tooth wedge portion 26. As an alternative to the disclosed preferred embodiment, the wing portions 16 and 18 may be even more gradually tapered with no discernable transition points.

In the preferred embodiment, the enlarged cross sectional segments of the locking device between interface points 48 and 56 and between interface points 50 and 58 are compressibly deformed to substantially fill the entire gap between the inner walls of pocket 20 and the deepest recesses of the detents 32 and 34. The locking device at these enlarged cross sectional segments effectively flows to substantially obscure interfaces 56 and 58 and present a substantially smooth contacting surface with the inner walls of pocket 20.

Total frictional surface area is maximized because substantially the entire gap between the inner tooth wedge portion 26 and the inner walls of pocket 20 is closed. Furthermore, a substantially uniform coefficient of friction is provided along the entire surface of frictional contact because the locking device is compressed to substantially the same degree of strain therealong. This uniformity in degree of compression along the locking device is significant to minimize isolated spots of increased friction which detract from the overall retention capability of the device.

Removal of the tooth is effected by hammer blows directed through bottom central aperture 74, FIGS. 4 and 2, in pocket 20.

In prior tooth locking arrangements, it is common to employ hardened metal for only one of the inner tooth wedge portion 26 and the inner walls of pocket 20 so that the softer of the materials will creep or flow upon wedging in order to enhance frictional retention, even when a compressive locking device is employed. The improved frictional retention afforded by the present invention eliminates the need for a softer material to be used in one of the tooth and the pocket, and instead allows both the inner tooth wedge portion 26 and the inner walls of pocket 20 to be of hardened material because of the superior retention capability of the present locking device. A variety of materials may be used for the locking device. The preferred material is high density PVC (polyvinyl chloride).

It is recognized that various modifications are possible within the scope of the appended claims.

I claim:

1. A locking device for releasably mounting a digging tooth within a tooth receiving pocket of excavation equipment wherein said tooth has an outer work-engaging portion and an inner wedge portion received in said pocket in generally complemental matingly wedged relation, said inner tooth wedge portion having recessed detents formed on opposing sides adjacent the end thereof for receiving said locking device, said locking device comprising a compressible member having a generally tubular hollow portion with a slit along its longitudinal dimension and a pair of diverging wing portions extending from opposing faces of said slit, said locking device tubular portion having inner and outer perimeters, said locking device wing portions having inner facing surfaces with divergent distal ends and convergent proximal ends interfacing with said inner perimeter of said tubular portion to form said opposing faces of said slit, said locking device wing portions having outer planar surfaces with divergent distal ends and convergent proximal ends interfacing with said outer perimeter of said tubular portion, said locking device having an enlarged cross-sectional dimension between each of the inner and outer interfaces of said tubular portion inner perimeter with said wing portion inner proximal end, and said tubular portion outer perimeter with said wing portion outer proximal end, respectively, which is thicker than the cross-sectional dimension of said tubular portion and said wing portion, said locking device being mounted to said tooth wedge portion with the opposed interfaces of said wing portion inner surface proximal ends and said tubular portion inner perimeter engaging said recessed detents and with said tubular portion inner perimeter engaging the end of said inner tooth wedge portion, said locking device being compressively deformed in an assembled mounting condition with said tooth inserted in said pocket, said locking device being compressed between said tooth wedge portion and the inner walls of said pocket, said enlarged cross-sectional segments of said locking device substantially filling said recessed detents to compensate the increased gap to the pocket interior wall and increase the total frictional surface area of engagement to enhance retention of said tooth in said pocket, said tooth wedge portion having a bight section at the end thereof having a cross-sectional dimension which is thicker than the thinnest section between said recessed detents but thinner than the remainder of said tooth wedge portion, said locking device tubular portion inner perimeter engaging said bight section and compressed to substantially the same degree of strain in said pocket as said enlarged cross-sectional segments of said locking device whereby to enhance frictional retention of said tooth in said pocket by providing a substantially uniform coefficient of friction along said locking device surfaces bounding said tubular portion and said enlarged cross-sectional segment, and said recessed detents having deepest sections providing the smallest cross-sectional thickness adjacent said bight section and being tapered to diverge outwardly to shallower depths and away from said bight section to merge with the remaining cross-sectional profile thickness of said tooth wedge portion, and wherein said wing portions are tapered at said distal ends thereof to a reduced cross-sectional thickness to compensate and complement said tapered recessed detents, such that said wing portions are compressed between said tooth wedge portion tapered recessed detents and the inner walls of said pocket to substantially the same degree of strain as said enlarged cross-sectional segments and said tubular portion of said locking device, whereby to minimize isolated spots of increased friction and maximize uniformity of friction along the entire surface of said locking device.

2. The invention according to claim 1 wherein said taper in said locking device wing portions is formed on said outer surfaces thereof.

3. A locking device for releasably mounting a digging tooth within a tooth receiving pocket of excavation equipment wherein said tooth has an outer work-engaging portion and an inner wedge portion received in said pocket in generally complemental matingly wedged relation, said inner tooth wedge portion having recessed detents formed on opposing sides adjacent the end thereof for receiving said locking device, said locking device comprising a compressible member having a generally tubular hollow portion with a slit along its longitudinal dimension and a pair of diverging wing portions extending from opposing faces of said slit, said locking device tubular portion having inner and outer perimeters, said locking device wing portions having inner facing surfaces with divergent distal ends and convergent proximal ends interfacing with said inner perimeter of said tubular portion to form said opposing faces of said slit, said locking device wing portions having outer planar surfaces with divergent distal ends and convergent proximal ends interfacing with said outer perimeter of said tubular portion, said locking device having an enlarged cross-sectional dimension between each of the inner and outer interfaces of said tubular portion inner perimeter with said wing portion inner proximal end, and said tubular portion outer perimeter with said wing portion outer proximal end, respectively, which is thicker than the cross-sectional dimension of said tubular portion and said wing portion, said locking device being mounted to said tooth wedge portion with the opposed interfaces of said wing portion inner surface proximal ends and said tubular portion inner perimeter engaging said recessed detents and with said tubular portion inner perimeter engaging the end of said inner tooth wedge portion, and said tooth wedge portion having a bight section at the end thereof having a cross-sectional dimension which is thicker than the thinnest section between said recessed detents but thinner than the remainder of said tooth wedge portion, and wherein said recessed detents have deepest sections providing the smallest cross-sectional thickness adjacent said bight section and are tapered to diverge outwardly to shallower depths away from said bight section to merge with the remaining cross-sectional profile thickness of said tooth wedge portion, said locking device tubular portion inner perimeter engaging said bight section, said opposed interfaces of said wing portion inner surface proximal ends and said tubular portion inner perimeter engaging said deepest sections of said recessed detents, and wherein said wing portions are tapered at said distal ends thereof to a reduced cross-sectional thickness to compensate and complement said tapered recessed detents such that said wing portions are compressed between said tooth wedge portion tapered recessed detents and the inner walls of said pocket in assembled mounting condition.

4. The invention according to claim 3 wherein said wing portions have transition points initiating said taper, these transition points being oriented such that in said assembled mounting condition they are disposed proximate that point in the changing cross sectional thickness between said tapered recessed detents which is substantially equal to the cross sectional thickness of said bight section.

5. The invention according to claim 3 wherein said locking device is extruded polyvinyl chloride.

6. The invention according to claim 3 wherein both said inner tooth wedge portion and said pocket inner walls are hardened to a high and substantially the same degree of hardness.

* * * * *